US005535974A

United States Patent [19]

Savitski

[11] Patent Number: 5,535,974

[45] Date of Patent: Jul. 16, 1996

[54] SCAFFOLD BRACKET

[76] Inventor: Richard H. Savitski, 14255 88th St. NE., Elk River, Minn. 55330

[21] Appl. No.: 207,250

[22] Filed: Mar. 7, 1994

[51] Int. Cl.[6] ..... E04G 3/08

[52] U.S. Cl. ..... 248/246; 248/235; 182/82

[58] Field of Search ..... 248/246, 245, 248/244, 243, 241, 235, 240; 182/82, 113, 179, 178

[56] References Cited

U.S. PATENT DOCUMENTS

| | | | |
|---|---|---|---|
| 1,449,700 | 3/1923 | Sampson | 248/235 |
| 2,414,078 | 1/1947 | Wetzel | 248/235 X |
| 2,573,086 | 10/1951 | Yoshimoto | 248/235 |
| 2,577,979 | 12/1951 | Pierson et al. | 248/235 |
| 2,592,057 | 4/1952 | Murphey | 248/235 |
| 2,805,902 | 9/1957 | Drasek et al. | 248/235 X |
| 2,833,503 | 5/1958 | Harshbarger et al. | 248/235 |
| 2,882,101 | 4/1959 | Michalak et al. | 248/235 |
| 2,997,268 | 8/1961 | Dimmitt | 248/235 |
| 3,595,510 | 7/1971 | Hutchinson | 248/235 X |
| 3,970,277 | 7/1976 | Riblet | 248/246 |
| 4,372,425 | 2/1983 | Murphy | 248/235 X |
| 4,909,350 | 3/1990 | Jacobs | 248/235 X |

*Primary Examiner*—David M. Purol

*Attorney, Agent, or Firm*—Merchant, Gould, Smith, Edell, Welter & Schmidt

[57] ABSTRACT

The present invention includes a scaffold bracket which is removably attachable to an elongated member such as the stud of a building under construction. The scaffold bracket includes a support structure having a support arm, and first and second grippers attached to the support structure. The first and second grippers engage the front and back surfaces of the elongated member, respectively. When the bracket is mounted to the elongated member, the support arm extends substantially horizontally. In this mounted position, a downward force on the support arm causes the first and second grippers to exert a gripping force on the elongated member. The invention also includes a scaffolding system employing such a scaffold bracket.

18 Claims, 4 Drawing Sheets

SCAFFOLD BRACKET

BACKGROUND OF THE INVENTION

The present invention relates generally to a scaffold bracket used to form scaffolding for construction projects. More particularly, the invention relates to a scaffold bracket which easily and securely attaches directly to the building under construction.

During construction of a building, it is often desirable to construct scaffolding which allows construction workers to work on an elevated portion of the building. Typically, scaffolding is made up of a number of scaffold sections which are based on the ground and stacked on top of one another in order to build up the scaffolding to a desired height. Such scaffolding is generally very cumbersome and difficult to assemble, adjust and transport.

SUMMARY OF THE INVENTION

The present invention is a scaffolding bracket which attaches directly to a stud of the building under construction. It is very simple, easy to transport, and easy to adjust, so that the height and position of the scaffolding can be changed very quickly. At the same time, the scaffold bracket grips the stud securely so as to provide a safe platform on which to work.

The present invention includes a scaffold bracket which is removably attachable to an elongated member such as the stud of a building under construction. The scaffold bracket includes a support structure having a support arm, and first and second grippers attached to the support structure. In the mounted position, the first and second grippers engage the front and back surfaces of the elongated member, respectively, and the support arm extends substantially horizontally. In this mounted position, a downward force on the support arm causes the first and second grippers to exert a gripping force on the elongated member.

The scaffold bracket is preferably rotatable between the mounted position described above, and a release position where the elongated member is free to extend between the first and second grippers.

Preferably, the support structure further includes a gripper arm attached to the support arm, and a strengthening arm extending between the gripper arm and support arm. In the most preferred arrangement, the grippers are attached to the gripper arm and are movable relative to each other so as to accommodate elongated members of different width.

The invention also includes a scaffolding system made up of a plurality of scaffold brackets described above.

DETAILED DESCRIPTION OF THE PREFERRED EMBODIMENTS

Figure 1:
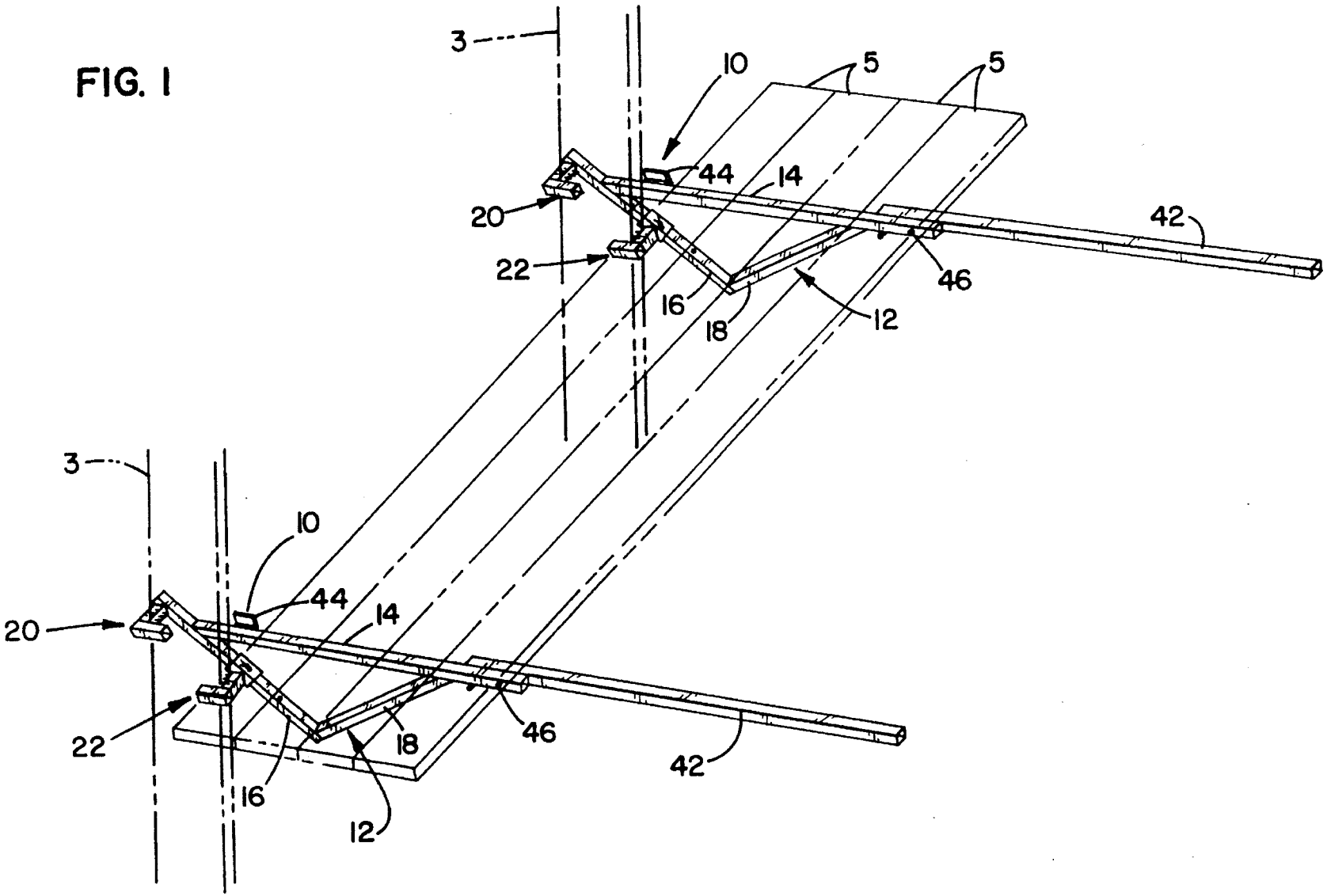
FIG. 1 is a perspective view of a scaffold system employing one embodiment of scaffold brackets made according to the present invention.

FIG. 1 shows a scaffolding system employing one embodiment of scaffold brackets 10 made according to the present invention. The brackets are shown connected to two vertical studs 3 which can be, for example, from a building which is under construction. Boards 5 extends between the two scaffold brackets 10, and form a supporting surface on which a construction worker may stand while working on the building.

Figure 2:
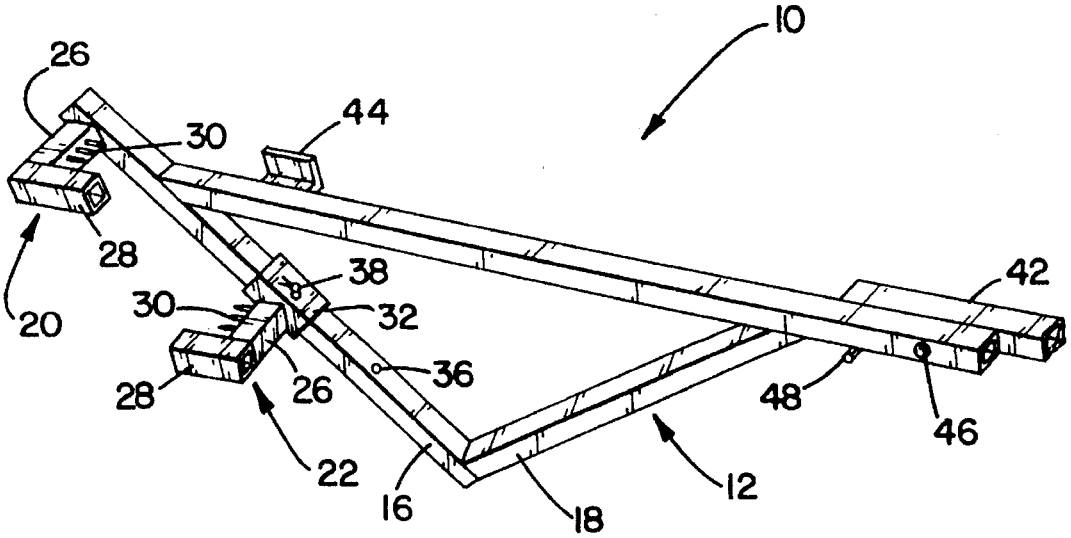
FIG. 2 is a perspective view of the scaffold bracket of FIG. 1, partially broken away.

The scaffold bracket is shown in further detail in FIG. 2. Each scaffold bracket 10 is made up a support structure 12 and a gripping means made up of grippers 20 and 22. Support structure 12 preferably includes a support arm 14, a gripper arm 16 and a strengthening arm 18. The arms of the support structure are preferably made up of square hollow steel tubing which is about 1 inch wide and which has a wall thickness of about ⅛ inch. The arm of the support structure are fixedly connected to each other, preferably by welding, so as to form a generally-triangular shape.

Grippers 20 and 22 are attached to gripper arm 16. In the preferred embodiment, gripper 20 is fixedly attached to one end of arm 16, such as by welding, while gripper 22 is adjustably attached to arm 16, as hereinafter described. The grippers are preferably L-shaped members. One leg 26 of the grippers extends perpendicular to arm 16, while the other leg 28 extends perpendicular to leg 26. The L-shaped grippers may be made of the same square hollow steel tubing which makes up the support structure. Grippers 20 and 22 are preferably attached to arm 16 so as to lie in a plane parallel to support arm 14.

An engaging means extends inwardly from the leg 26 of each gripper to engage the stud 3. Engaging means may be nails 30 (cement nails are preferred for their strength) which are inserted through holes formed in leg 26. The nails preferably extend between ¼ and ½ inch out of the leg 26 for gripping the stud.

The horizontal space between legs 26 of grippers 20 and 22 is approximately equal to the width of the stud S, so that the grippers securely grip the stud. In order to accommodate studs of different widths, gripper 22 is preferably adjustable. This is achieved by an adjustment means made up of a slidable collar 32, slidably mounted on arm 16, to which gripper 22 is attached. Slidable collar 32 may be made of square hollow steel tubing which is sized to have an inner width which is substantially equal to the outer width of arm 16. Holes extend through opposing sides of collar 32. Holes 36 also extend through opposing sides of arm 16. A locking pin 38 may be used to lock the collar in any one of a number of predetermined locations defined by the position of holes 36. Thus, for example, the collar is preferably lockable in one position where the scaffold bracket will accommodate 2×4 studs, and another position where the bracket will accommodate 2×6 studs.

Figure 5:
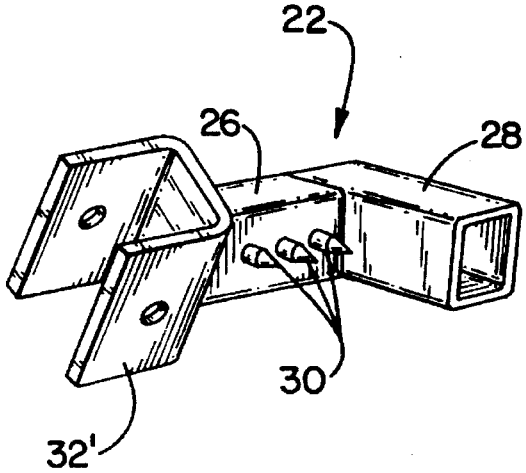
FIG. 5 is a perspective view of an alternative embodiment of an adjustable collar used with the scaffold bracket of either FIGS. 1 or 3.

For maximum strength, the collar 32 preferably has four walls, as shown in FIGS. 1 and 2. However, for manufacturing reasons, it may be desirable to form the collar as a U-shaped channel, as shown in FIG. 5. Such a collar 32' may be preferable because the gripper 22 and collar 32' can be manufactured separately from the rest of the scaffold bracket. If the collar is so formed, however, it may also be desirable to form the channel out of higher-gauge steel in order to compensate for the loss of strength caused by the removal of one of the side walls.

In use, the scaffold bracket is attached to the stud by tilting the bracket clockwise relative to the position shown in FIGS.

1 and 2. In this tilted position, the stud can be inserted through the space formed between the legs of grippers 20 and 22. Once the bracket is positioned so that the stud contacts the arm 16, the bracket is rotated clockwise to the position shown in FIGS. 1 and 2. In this position, gripper 20 engages the back wall of stud 3, while gripper 22 engages the front wall of stud 3 at a position vertically below that of gripper 20. Nails 30 are forced into the stud, thus further preventing the bracket from slipping. The support arm 14 extends substantially horizontally, so as to provide a level support surface for boards 5.

Importantly, any downward force on support arm 14 increases the gripping force which grippers 20 and 22 apply to the stud 3. Hence, as additional weight is applied to the scaffold (such as by the addition of more workers or working materials), the grippers merely engage the stud even more tightly. The result is a very safe scaffold structure which can bear large loads.

Figure 3:
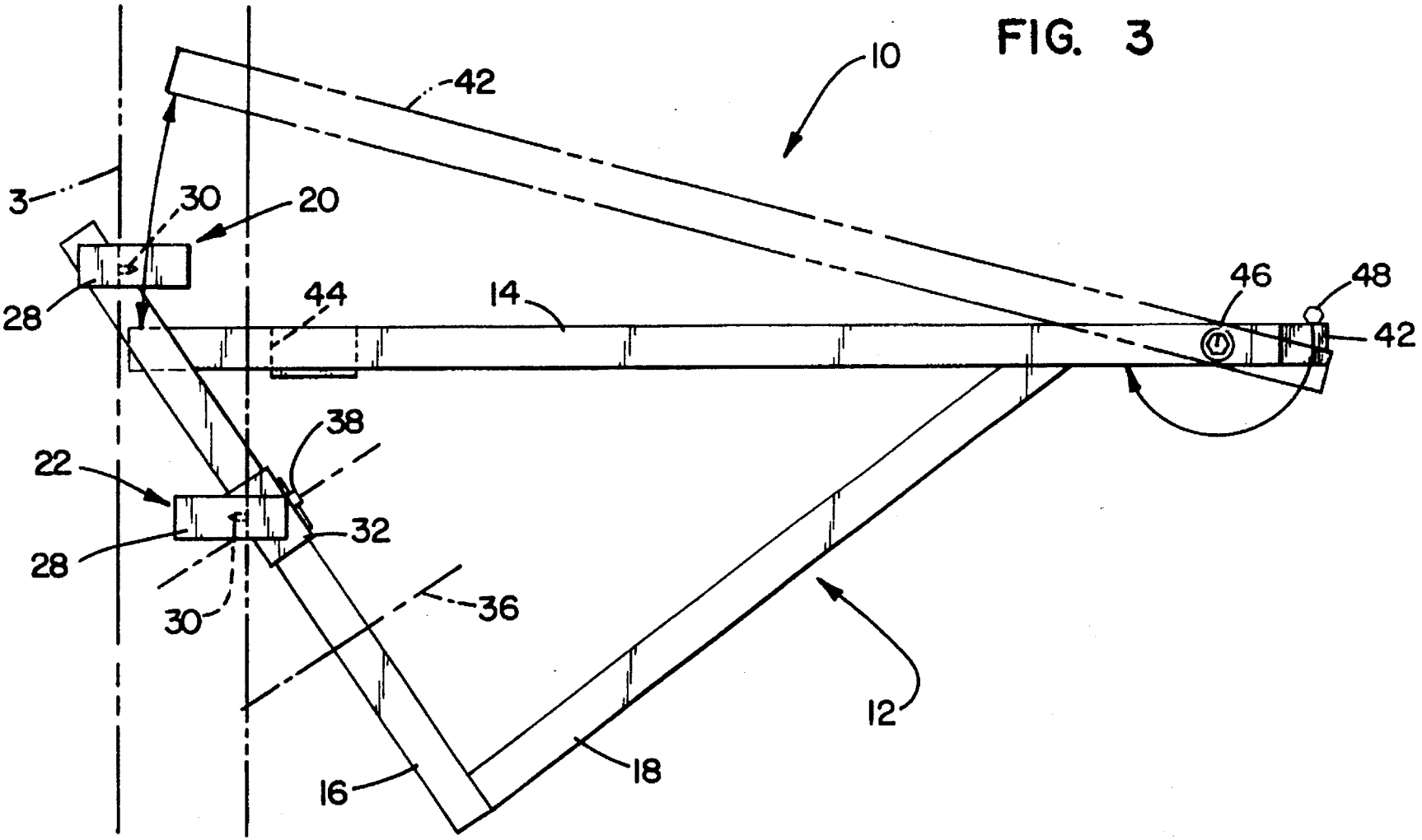
FIG. 3 is a side view of the scaffold bracket of FIG. 1.

As shown in the embodiment of FIGS. 1–3, an extension arm 42 may be hingedly connected to support arm 14 by a hinge 46. A stop 48 attached to extension arm 42 engages the arm 14 when in the open position shown in FIG. 1, so as to prevent further rotation of extension arm 42. The advantage of this structure is that it permits an increase in the length of the supporting surface formed by arms 14 and 42 during use of the scaffold bracket, while allowing the extension arm to be folded for increased compactness when the bracket is not in use. A stop 44 prevents further rotation of the extension arm when it is in the closed position. In this embodiment, both the support arm and the extension arm may be approximately 2 feet long, so that the scaffold bracket, when extended, provides a supporting surface which is approximately 4 feet long.

Figure 4:
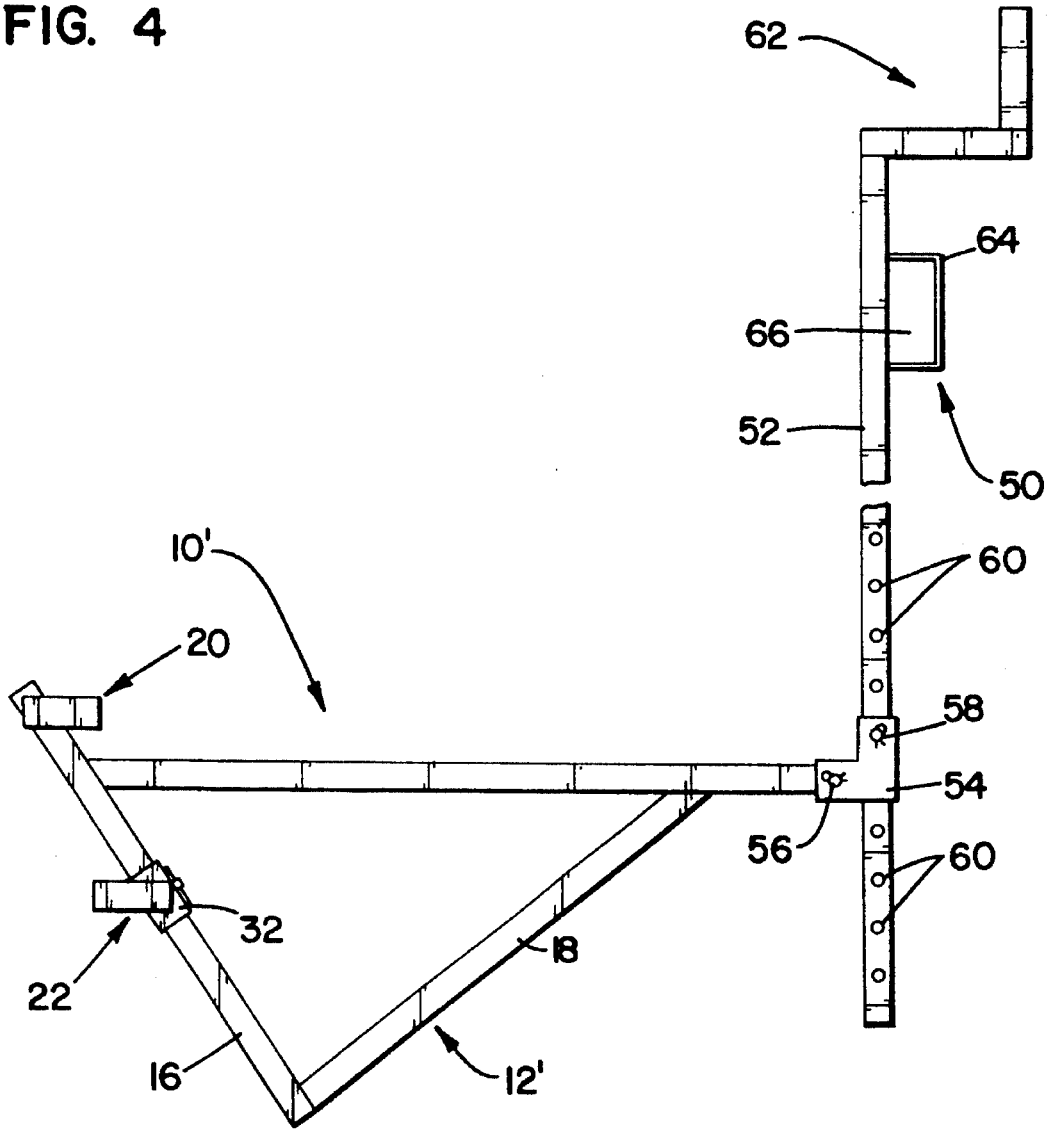
FIG. 4 is a side view of a second embodiment of a scaffold bracket made according to the present invention.

A second embodiment of a scaffold bracket 10' made according to the present invention is shown in FIG. 4. The primary difference between the embodiment of FIG. 4 and the embodiment of FIG. 1 is that the support structure 12' has been modified to include a safety rail support means 50. The safety rail support means is made up of a safety rail arm 52 which is attached to the end of support arm 14 by a connecting elbow 54.

Safety rail arm 52 may be formed out of the same square hollow steel tubing which makes up arms 14–18. Connecting elbow 54 is made up of similar square tubing of larger size, so that arms 14 and 52 fit within the connecting elbow. Locking pins 56 and 58 extend through openings in connecting elbow 54 and in arms 14 and 52 so as to connect the arms to the elbows. Preferably, safety rail arm 52 has a plurality of holes 60 therein, so that the height of the arm may be adjusted. In this embodiment, arms 14 and 52 may both be approximately 3 feet long.

The upper end of arm 52 may form a ledge 62 for supporting construction materials and tools. Moreover, a U-shaped bracket 64 is preferably fixed to arm 52 so as to form a channel 66. The bracket is sized so that a board, for example a 2×4, can be inserted through the channels of two scaffold brackets so as to form a safety rail.

The foregoing constitutes a description of the preferred embodiments of the invention. Numerous modifications are possible without departing from the spirit and scope of the invention. For example, the grippers could be sized and positioned so as to accommodate narrower or wider studs. The length and orientation of the support and strengthening arms can be varied. The scaffold bracket could be modified so as to attach to non-vertical beams, such as rafters of a roof. Different sizes and cross-sectional shapes for the various parts could be employed.

Hence, the scope of the invention should be determined with reference, not to the preferred embodiment, but to the following claims.

I claim:

1. A scaffold bracket which is removably attachable to a substantially vertical elongated member having a front surface and a back surface, comprising:

a support structure having a support arm and a gripper arm attached to the support arm;

first and second grippers attached to the gripper arm for engaging the front and back surfaces of the elongated member, respectively, the first and second grippers being adjustable between a plurality of predetermined positions apart so as to accommodate elongated members of different widths; and a collar attached to the second gripper which extends around the gripper arm and a locking pin;

wherein the first gripper is fixed to the gripper arm, and wherein the second gripper is adjustable between a plurality of predetermined positions along the gripper arm;

wherein the gripper arm has a plurality of openings extending therethrough, wherein the collar has an opening extending therethrough, and wherein the locking pin may be selectively inserted through the opening in the collar and one of the openings in the gripper arm so as to adjust the second gripper relative to the first gripper; and wherein when the bracket is mounted to the elongated member, the support arm extends substantially horizontally, and wherein a downward force on the support arm causes the first and second grippers to exert a gripping force on the elongated member.

2. The scaffold bracket as claimed in claim 1, wherein the support structure further comprises a strengthening arm extending between the support arm and the gripper arm.

3. The scaffold bracket as claimed in claim 1, wherein said collar is square-shaped in cross-section.

4. The scaffold bracket as claimed in claim 1, wherein said collar is U-shaped in cross-section.

5. The scaffold bracket as claimed in claim 1, further comprising an extension arm which is hingedly connected to the support arm.

6. A scaffold bracket which is removably attachable to an elongated member having a front surface and a back surface, comprising:

a support structure having a support arm and a gripper arm attached to the support arm; and first and second grippers attached to the gripper arm for engaging the front and back surfaces of the elongated member, respectively, wherein said first and second grippers are each an L-shaped member having a first leg extending substantially perpendicular to the gripper arm, and a second leg extending substantially perpendicular to the first leg; and wherein when the bracket is mounted to the elongated member, the support arm extends substantially horizontally, and wherein a downward force on the support arm causes the first and second grippers to exert a gripping force on the elongated member.

7. The scaffold bracket as claimed in claim 6, wherein said L-shaped members are located in a plane which is substantially parallel to the support arm.

8. The scaffold bracket as claimed in claim 6, further comprising engagement means attached to the first legs of the grippers for engaging the elongated member.

9. A scaffold bracket which is removably attachable to an elongated member having a front surface and a back surface, comprising:

a support structure having a support arm;

first and second grippers attached to the support structure for engaging the front and back surfaces of the elongated member, respectively;

a safety rail arm attached to one end of the support arm and extending substantially perpendicular thereto; and means for adjusting the height of the safety rail arm relative to the support arm;

wherein when the bracket is mounted to the elongated member, the support arm extends substantially horizontally, wherein a downward force on the support arm causes the first and second grippers to exert a gripping force on the elongated member, wherein said adjusting means comprises a connecting elbow for connecting the safety rail arm to the support arm and a locking pin, wherein the safety rail arm has a plurality of openings extending therethrough, wherein the connecting elbow has an opening extending therethrough, and wherein the locking pin may be selectively inserted through the opening in the connecting elbow and one of the openings in the safety rail arm so as to adjust the safety rail arm relative to the support arm.

10. The scaffold bracket as claimed in claim 9, wherein said safety rail arm has a horizontal ledge portion at an upper end thereof.

11. The scaffold bracket as claimed in claim 10, further comprising a U-shaped bracket attached to the safety rail arm which forms a channel for receiving a safety rail.

12. A scaffold bracket which is removably attachable to a substantially vertical elongated member having a front surface and a back surface, comprising:

a support structure having a support arm and a gripper arm rigidly attached to the support arm and extending at an angle thereto;

first and second grippers attached to the gripper arm, at longitudinally spaced positions along said gripper arm; and a collar attached to the second gripper which extends around the gripper arm and a locking pin;

wherein the bracket is rotatable between a first position where the elongated member may be inserted between the first and second grippers by moving the bracket laterally and a second position where the support arm extends substantially horizontally, the first gripper engages the front surface of the elongated member, and the second gripper engages the back surface of the elongated member at a position above the first gripper;

wherein the first and second grippers are movable relative to each other so as to accommodate elongated members of different widths; and wherein the first gripper is fixed to the gripper arm, wherein the gripper arm has a plurality of openings extending therethrough, wherein the collar has an opening extending therethrough, and wherein the locking pin may be selectively inserted through the opening in the collar and one of the openings in the gripper arm so as to adjust the second gripper relative to the first gripper.

13. The scaffold bracket as claimed in claim 12, wherein when the bracket is in the second position, a downward force on the support arm causes the first and second grippers to exert a gripping force on the elongated member.

14. The scaffold bracket as claimed in claim 12, wherein the support structure further comprises a strengthening arm extending between the support arm and the gripper arm.

15. The scaffold bracket as claimed in claim 12, wherein said first and second grippers are each L-shaped member having a first leg extending substantially perpendicular to the gripper arm, and a second leg extending substantially perpendicular to the first leg.

16. The scaffold bracket as claimed in claim 15, wherein said L-shaped members are located in a plane which is substantially parallel to the support arm.

17. The scaffold bracket as claimed in claim 15, further comprising engagement means attached to the first legs of the grippers for engaging the elongated member.

18. A scaffolding system to be mounted on a plurality of substantially vertical elongated members, each elongated member having a front side and a back side, the system comprising:

a plurality of scaffold brackets, each bracket comprising:

a support structure having a support arm and a gripper arm attached to the support arm;

first and second grippers attached to the gripper arm for engaging the front and back surfaces of one of the elongated members, respectively; and a collar attached to the second gripper which extends around the gripper arm and a locking pin;

wherein the first gripper is fixed to the gripper arm, and wherein the second gripper is adjustable between a plurality of predetermined positions along the gripper arm;

wherein the gripper arm has a plurality of openings extending therethrough, wherein the collar has an opening extending therethrough, and wherein the locking pin may be selectively inserted through the opening in the collar and one of the openings in the gripper arm so as to adjust the second gripper relative to the first gripper; and wherein each bracket is rotatable between a first position where the elongated member may be inserted between the first and second grippers by moving the bracket laterally and a second position where the support arm extends substantially horizontally, the first gripper engages the front surface of the elongated member, and the second gripper engages the back surface of the elongated member at a position above the first gripper; and at least one board resting on the support arms of said scaffold brackets.

* * * * *